US005133378A

United States Patent [19]

Tanasychuk

[11] Patent Number: 5,133,378

[45] Date of Patent: Jul. 28, 1992

[54] ICE FISHING SHELTER

[76] Inventor: William Tanasychuk, 75 Manor Dr., Rossburn, Canada, R0K 1V0

[21] Appl. No.: 709,701

[22] Filed: Jun. 3, 1991

[51] Int. Cl.[5] ..... E04H 15/48

[52] U.S. Cl. ..... 135/109; 135/112; 135/901

[58] Field of Search ..... 135/109, 901, 113, 112, 135/115; 52/638, 657, 655

[56] References Cited

U.S. PATENT DOCUMENTS

| | | | |
|---|---|---|---|
| Re. 16,037 | 3/1925 | Berg | 135/112 X |
| 2,811,977 | 11/1957 | McClish | 135/96 X |
| 3,027,189 | 3/1962 | Scott | 135/109 X |
| 3,028,871 | 4/1962 | Clift, Jr. | 135/109 |
| 3,266,503 | 8/1966 | Hoiness et al. | 135/109 X |
| 3,683,947 | 8/1972 | Muller | 135/20.2 |
| 3,874,398 | 4/1975 | Hendrickson | 135/109 |
| 4,745,725 | 5/1988 | Onoda | 52/655 X |
| 4,938,243 | 7/1990 | Foster | 135/109 X |

FOREIGN PATENT DOCUMENTS

| | | | |
|---|---|---|---|
| 615722 | 3/1961 | Canada . | |
| 718144 | 9/1965 | Canada . | |
| 921794 | 2/1973 | Canada . | |
| 1062582 | 9/1979 | Canada | 135/109 |
| 1139181 | 6/1957 | France | 135/109 |
| 194649 | 2/1965 | Sweden | 135/109 |
| 0344798 | 3/1931 | United Kingdom | 135/112 |

*Primary Examiner*—David A. Scherbel
*Assistant Examiner*—Lan Mai
*Attorney, Agent, or Firm*—Robert M. Phipps

[57] ABSTRACT

The frame of a portable shelter is disclosed, particularly for use in ice fishing, wherein two planar, usually rectangular, top and bottom frame sections (10, 33) are held apart by an over-the-center linkage mechanism assisted by cable retainer arrangement (51, 52) associated with a seat portion (40) of the collapsible frame of the shelter.

2 Claims, 3 Drawing Sheets

ICE FISHING SHELTER

The present invention relates to collapsible shelters and in particular to a portable shelter useful in ice fishing.

Portable and collapsible shelters of this type have been known for a long time. They include a frame and of a flexible cover. The frame is usually a tubular frame comprised of a number of components interconnected with each other to allow folding and erecting of the frame as required. One of the welcome features of an ice fishing shelters is the inclusion within the shelter of a seat for the fisherman so that no additional seat has to be carried along with the collapsible shelter.

The following prior patents represent the state of the art known to the applicant: U.S. Pat. Nos. 3,509,891; 2,811,977; 3,799,608; 3,028,871; 4,252,136; 4,067,346 and 3,874,398; and Canadian Patents 300,286; 615,722; 718,144; and 921,794.

The above patents show a variety of different shelters including a tubular frame with some of the patents (U.S. Pat. Nos. 4,799,608 and 3,028,871) having seats incorporated in the structure. Most of the patents present complex and thus expensive and potentially unreliable structures.

Attempts have been made to simplify the structure of existing shelters of this kind. The above Canadian Patent 718,144 (Hoiness et al.) presents the best example of such simplification. A base frame and a top frame are interconnected by two variable V-shaped structures, one at each side. When the shelter is fully unfolded, the two arms of the V-shaped side structures are aligned flush with each other so that the apex angle of the V is 180 degrees. They are generally flush with each other when the frame is collapsed. The device is provided with a latch mechanism operated by a spring and adapted to releasably hold the two arm portions of the "V" of each side member aligned at said 180 degrees when the shelter is erected, and to also allow the folding of the arms back to the collapsed state, when an inwardly directed force is exerted at the joint between the arms.

While the Hoiness et al. shelter presents a simple structure, the latch mechanism holding the aligned arms in place is relatively weak and may allow the collapsing of the structure when not desired. Furthermore, the shelter frame does not include a seat portion.

It is an object of the present invention to further advance the art of shelters of this type by providing a simple frame which includes a seat frame and which allows a simple way of erecting the frame while virtually eliminating the possibility of undesired collapsing of the frame.

In general terms, the present invention provides a frame for a collapsible shelter of a generally rectangular contour in plan and forming, in an extended state, a top , a bottom, a front and a back, a first side and a second side, said frame comprising, in combination:

(a) a first base;

(b) a second base;

(c) link means pivotally secured to the first and second base to selectively maintain the first and second base in a first mutual position and in a second mutual position;

(d) said first mutual position being an extended state of the frame wherein the first and second base are vertically spaced from each other;

(e) said second mutual position being a folded state of the frame wherein the first and second base are generally flush with each other and with the link means;

(f) said link means comprising two link systems defining, in an extended state, said first and second side, respectively;

(g) each link system defining a transversely pointing, variable V-shaped structure comprised of a pair of arm portions pivotally secured to each other at an apex part, and having free end portions pivotally secured one to each of said bases at the same side of the frame;

(h) each link system comprising angle limiting stop means adapted to allow the change of the apex angle of said V from a generally zero value with the apex disposed inwardly of the frame, at which apex angle the frame is in said folded state, to a predetermined over-the-centre position, wherein the apex angle has moved from said generally zero to a convex angle, at which the apex forms generally the outermost point of the respective side, when the frame is in said extended state.

The side members of the frame thus present a mechanism known as an over-the-centre arrangement which is held in an extended, over-the-centre position, by a brace and does not require any moving parts such as a latch or the like, thus increasing the simplicity and reliability of the structure.

The invention will now be described by way of a preferred embodiment, with reference to the accompanying diagrammatic drawings in which certain elements of the structure have been omitted for clarity. In the drawings.

Figure 1:
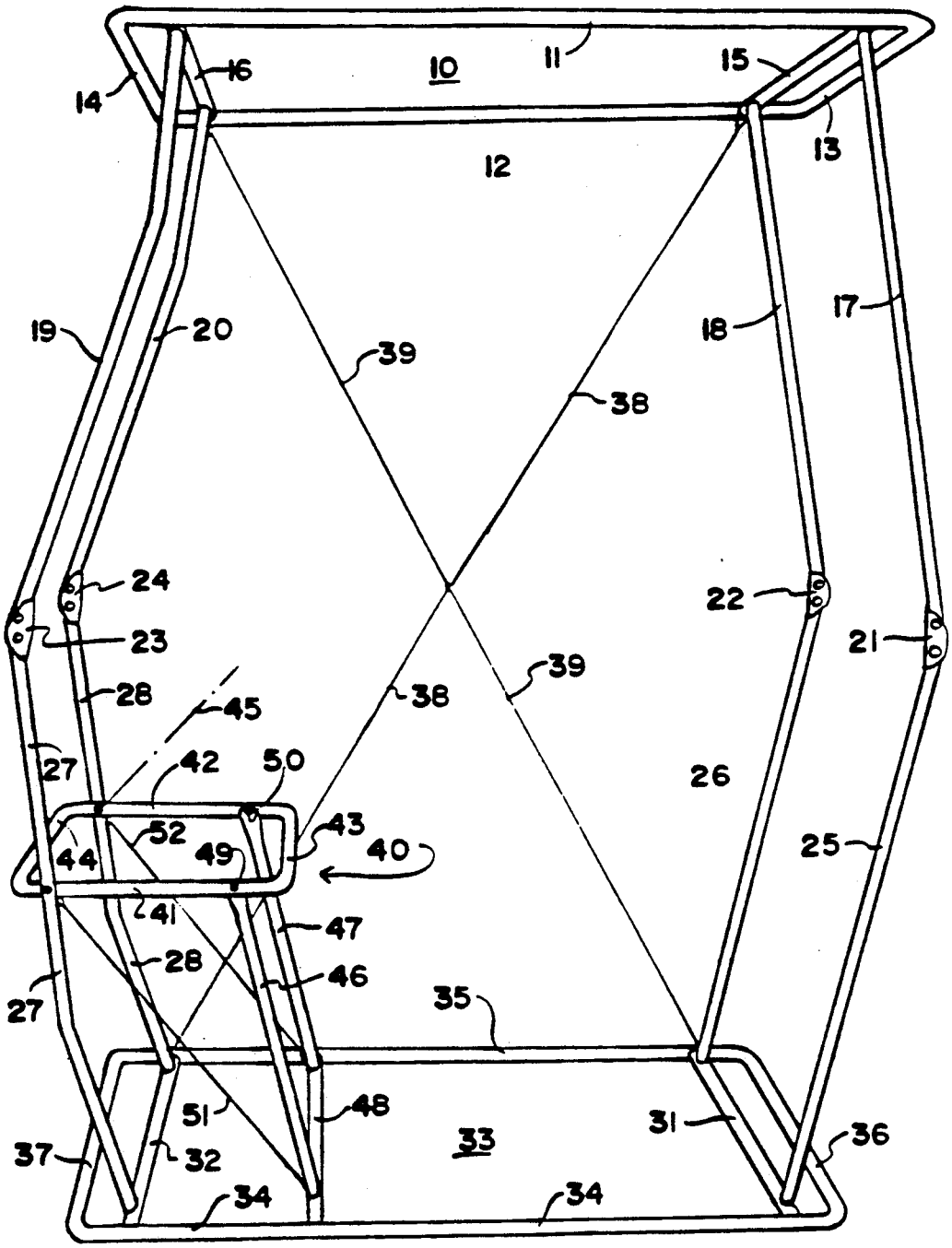
FIG. 1 is a perspective view showing the frame in a fully unfolded state.

The frame according to the present invention is provided with a top rectangular base 10 which may also be referred as a first or second base. The base 10 is a rigid, integral tubular structure comprised of a front tube section 11, a back tube section 12 and two opposed right and left side tube sections 13, 14. In a fully unfolded state, the base 10 forms the top of the shelter.

Pivotably secured to the front and back tube sections 11, 12 of the base 10 near its side sections 13, 14 are pivot tubes 15, 16, one at each side. The pivot tube 15 is integral with a front tubular section 17 and a back tubular section 18. The tubes 15, 17 and 18 thus form a rigid U-shaped link element pivotably secured to the base 10. At the opposed side of the frame, the pivot tube 16 is likewise integral with a front tubular section 19 and a rear tubular section 20 to form another rigid U-shaped link element. The free lower end portions of the front and back tubes 17, 18 are each pivotally secured each to one end of a brace 21, 22. The free ends of tubes 19, 20 at the opposed side are likewise pivotably secured each to a brace 23, 24.

Figure 3:
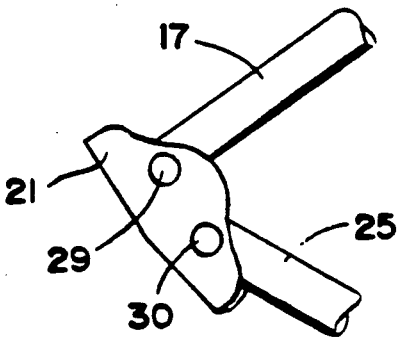
FIG. 3 is detail III of FIG. 2 showing a detail of an exemplary embodiment of stop means for maintaining the side members of the frame at a selected over-the-centre, salient angle.

The braces 21, 22, 23, 24 pivotably connect each of the tubes 17–20 to a respective front and back tubular sections 25–26 and 27–28 of the lower system of rigid U-shaped link elements such that there are two pivots, one at each end of the brace 21–24, as indicated by pivots 29, 30 in FIG. 3. The front and back link tubes or tubular sections 25, 26 are integral with the bottom pivot tube 31, to form one of the lower rigid U-shaped link elements, while the opposed front and back link tubes 27, 18 are similarly integral with a pivot tube 32, forming the second lower rigid U-shaped link element. The pivot tubes 31, 32 are disposed one at each side of a second, bottom base 33. The second base 22 is similar to the top or first base 10 in that it has the configuration of a rigid tubular frame comprised of a front and rear tube sections 34, 35, and two opposed side sections 36, 37. The bottom base 33 can also be referred to generally as a "second" or "first" base, depending on the selected designation of the top base 10.

The rigid U-shaped link elements 17-18-15 and 25-26-31 thus form a preferred embodiment of what could also be generally described as a link system defining a transversely pointing, variable V-shaped structure comprised of a pair of arm portions at the right of FIG. 1, (17, 18 being one arm, 25, 16 the other) pivotably secured to each other at an apex part (formed by the braces 21, 22), and having free end portions (pivot tube 15, 31) pivotably secured one to each of said bases 10, 33 at the same side of the frame;

The opposed rigid U-shaped link elements 19-20-16 and 27-28-32 could be described in the same general terms as forming another variable V-shaped structure.

A pair of diagonal cables 38, 39 is anchored to the upper and lower base 10, 33 such that in the erected state of FIG. 1 the cables are tight and intersect each other in an X-shaped fashion across and generally on the plane of a rear wall of the shelter.

The frame preferably includes a frame member 40 which comprises a rigid rectangular seat from having a front tube 41, a back tube 42 and two opposed side tubes 43, 44. The seat frame member is pivotably secured to the front and back tubes 27, 28 for relative pivoting of the seat frame relative to the tubes 27, 28 (which form the lower arm of the left-hand side 'V-shaped structure" described), about an axis 45. The axis 45 is spaced from the pivot tube 32 to provide the desired spacing of the seat member 40 above the ground, when the shelter is in a fully extended position. The inside of the frame 40 is formed by a support canvas stretched between the sides 41–44 of the seat frame. The support canvas is not shown in the drawings.

A rigid, forward support structure formed by a front support tube 46, a back support tube 47 and a transverse pivot tube 48, is pivotably secured, at a first or top end thereof, to the seat frame 40, at coaxial pivots 49, 50, and, at a second end thereof, at the pivot tube 48 to the second or bottom base 33 for pivoting relative to the frame 33 about the axis of the pivot tube 48. In effect, the part of the second base 33 located between the tubes 32, 48, the seat frame 40, the support structure formed by the tubes 46 and 47, and the lower end of the tubes 27, 28 form a collapsible parallelogram shaped structure. A pair of retaining cables 51, 52, stretching each across one of the parallelogram shaped structures along the front and the back of the shelter. As can be appreciated, the tight condition of the cables 51, 52 does not allow further movement of the parallelogram 34-27-41-46 to the left of FIG. 1 by the weight of a user seated on the seat 40. In this respect, the cables 51, 52 present additional reinforcement to the action of the braces 21–24 in retaining the desired unfolded position.

Figure 4:
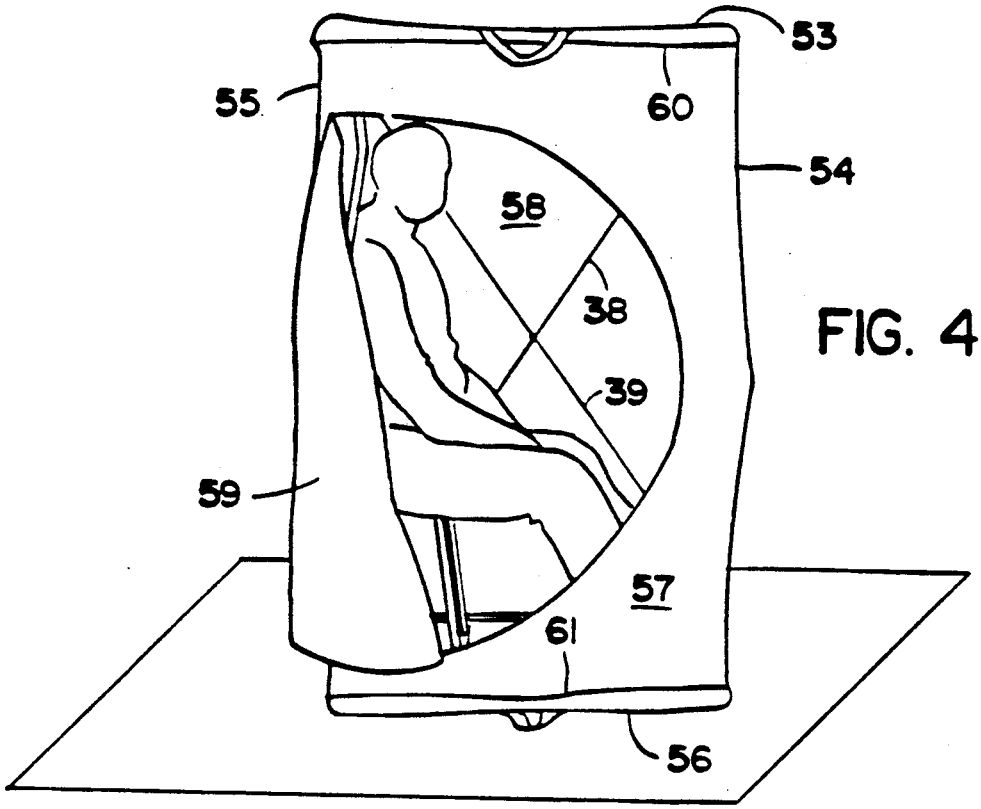
FIG. 4 is a diagrammatic representation of a shelter utilizing the frame of the invention, in an erected state.
Figure 5:
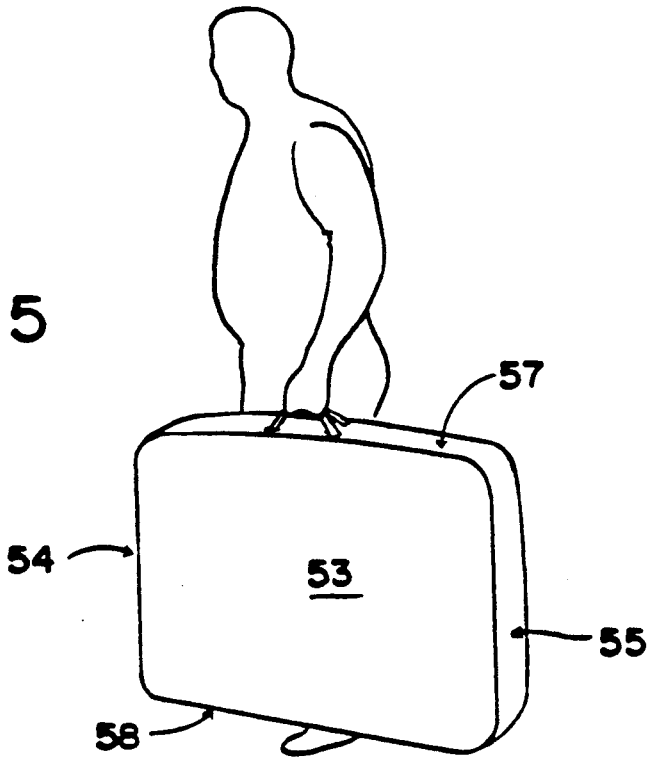
FIG. 5 is a diagrammatic representation of the shelter of FIG. 4 in a fully folded position.

The frame is disposed within a cover canvas which is only shown in FIGS. 4 and 5. Referring to FIG. 4, the shelter has a top 53, two opposed sides 54, 55, a bottom 56, a front 57 and a back wall 58 which, in the extended position, is coplanar with the "X" of the cables 38, 39.

The front wall 57 of the canvas cover has a slide fastener operated closing flap 59. A slide fastener stringers 60, 61 are provided one about the periphery of each of the top 53 and bottom 56. When desired, the slider of the slide fastener (not shown) is engaged with both stringers and slid around to hold the top 53 and bottom 56 in a generally flush, folded position shown in FIG. 5. In an extended state, the slide fastener is entirely disengaged from one of the stringers 60, 61 as is well known from the art of slide fasteners. The bottom 56 is provided with a slide fastener operated flap, not shown in the drawing, to allow access to a fishing hole drilled in the ice for ice fishing.

In operation, and assuming the shelter is entirely folded as shown in FIG. 5, the slide fastener mentioned above is first operated to entirely disengage the top and bottom stringers 60–61.

Figure 2:
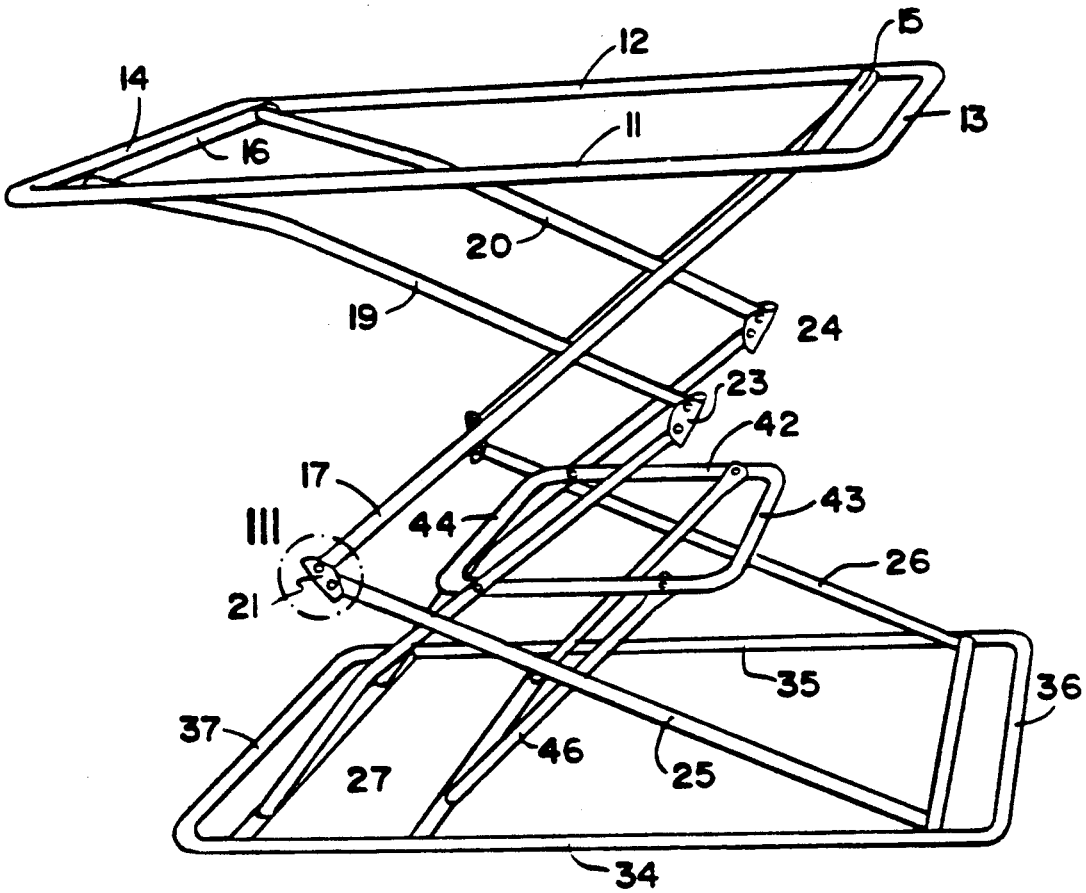
FIG. 2 is a view similar to that of FIG. 1 but showing the frame in a position between a fully unfolded state and a fully collapsed or folded state.

The top and bottom frames 10, 33 are pulled away from each other. This eventually results in a mutual arrangement of the linkage between the two bases 10, 33 as shown in FIG. 2. Here the V-shaped linkage arrangement on the sides of the shelter displays are acute angled apex disposed inside of the frame structure. In the position of FIG. 2, the flap 59 (not shown in FIG. 2) can be opened and the side linkage systems 17-18-25-26 and 19-20-27-28 are pushed each to its side from within the shelter. This results in further the movement of the bases 10, 33 away from each other until the cables 38-39 are tight but the apexes formed by the braces 21–24 are still inside the frame. A final push outwardly and sideways brings the apexes 21-24 to the over-the-centre salient angle position outside of the frame limited, on the one hand, by the braces 21–24, on the other, by the cables 51, 52 of the seat 40. In this final stage of the unfolding, the cables 38, 39 along the back wall of the shelter cause a minor flexible distortion of the links as they move to the over-the-centre position, to immediately return to the regular state once the V-shaped linkages move to the over-the-centre stop position in which the apex angle is salient. The stretching of the canvas over the frame provides further force which is to be overcome on movement to the over-the-centre state, at which the apex angles at the sides are outwardly convex, as shown in FIG. 1. The force to be overcome on unfolding the shelter is important for maintaining the shelter erected and preventing inadvertent collapse by ensuring that a substantially inwardly directed force has to be exerted at apexes 21–24 to cause the collapse from the state of FIG. 1, over that of FIG. 2 and back to the fully folded state of FIG. 5, where the shelter is ready to be carried away.

The invention provides a substantial simplification of the overall structure of the frame which is less prone to undesired, sudden collapse of an erected shelter, while facilitating the erection due to the over-the-centre system which provides a more reliable indication of the fully unfolded state having been achieved, than the known systems similar to the Hoiness et al. system referred to at the outset.

Those skilled in the art will readily appreciate that many modifications of the shelter according to the invention an be made which depart from the embodiment described without departing from the invention. Strictly as a few examples, the stop means of the over-the-centre mechanism can be many other known types. The use of slide fasteners as described, while preferred, is also optional. The contour in plan of the embodiment described is rectangular. This is not to say that other shapes, for instance an octagonal contour, could not be made.

Accordingly, I wish to protect by letters patent which may issue on his application all such embodiments as properly and fairly fall within the scope of my contribution to the art.

I claim:

1. A frame for a collapsible shelter forming, in an extended state, a top, a bottom, a front and a back, a first side and a second side, said frame comprising, in combination:

(a) a first base;

(b) a second base;

(c) link means pivotally secured to the first and second base to allow a selective placement of the first and second base in a first mutual position and in a second mutual position;

(d) said first mutual position being an extended state of the frame wherein the first and second base are vertically spaced from each other at a predetermined spacing;

(e) said second mutual position being a folded state of the frame wherein the first and second base are generally flush with each other and with the link means;

said link means comprising two link systems defining, in an extended state, said first and second side, respectively;

(g) each link system including a transversely pointing, variable V-shaped structure comprised of a pair of arm portions pivotably secured to each other at an apex part, and having free end portions pivotably secured one to each of said bases at the same side of the frame;

(h) each link system further comprising angle limiting stop means adapted to limit the change of the apex angle of aid V from generally zero degrees, with the apex disposed inwardly of the frame, at which apex angle the frame is in said folded state, to a predetermined over-the-centre position, wherein the apex angle a salient angle;

(i) the stop means including brace means pivotably secured to the respective arm portions at two closely spaced apart, distinct pivot points each brace means being adapted to abut against an inner part of each of the respective arm portions structure when a predetermined convex angle been reached;

(j) each arm of each V-shaped structure including a pair of spaced-apart, parallel tubular sections, the spacing between the tubular sections generally corresponding to the spacing between the front and the back of the frame;

(k) the first base being a top base and the second base being a bottom base, said frame further comprising a seat frame member, said seat frame member, including:

(a) a rigid seat frame pivotably secured to the tubular sections of a normally lower arm of one of said V-shaped structures, for relative pivoting of the seat frame and the lower arm about an axis generally perpendicular to the plane of the "V" and disposed at a predetermined distance from the free end of the lower arm;

(b) a rigid, forward support structure pivotably secured, at a first end thereof, to a front part of the seat frame, the second end of the support structure being pivotably secured to the second base such that an adjacent section of second base, the seat frame, the support structure and the lower arm form a collapsible parallelogram shaped structure.

2. The frame as claimed in claim 1 wherein said parallelogram shaped structure includes a pair of retaining cables having an even, predetermined length and extending one along each of the front and rear of the frame, from said axis to a diagonally opposite point of the parallelogram shaped structure.

* * * * *